United States Patent [19]

Bean

[11] Patent Number: 4,600,197

[45] Date of Patent: Jul. 15, 1986

[54] BEARING STOP PLATE ASSEMBLY FOR SLOT MACHINE HANDLE MECHANISM

[76] Inventor: Jack Bean, 33 Gerald Pl., Bayville, N.J. 08721

[21] Appl. No.: 714,901

[22] Filed: Mar. 22, 1985

[51] Int. Cl.[4] ..... A63F 5/04

[52] U.S. Cl. ..... 273/143 R

[58] Field of Search ..... 273/143

[56] References Cited

U.S. PATENT DOCUMENTS 4,358,114 11/1982 Burnside ..... 273/143 R

*Primary Examiner*—Paul E. Shapiro

*Attorney, Agent, or Firm*—Clifford G. Frayne

[57] ABSTRACT

A bearing stop plate assembly for slot machines for support of the reel shelf and alignment of the reel mechanism and handle mechanism comprising a bearing plate having a first and second side, with perimeter flanges perpendicular to the second sides, the perpendicular flanges having a plurality of openings therethrough for securing the bearing plate within the slot machine, a horizontal slide guide extending outwardly from the first side of the bearing plate for cooperation with the downwardly depending lip of the reel shelf, the slide guide having a plurality of openings to receive threaded fasteners in order to secure the reel shelf, the slide guide and threaded fasteners thereby positioning and securing the reel shelf and maintaining the alignment of the handle and reel mechanism of the slot machine.

3 Claims, 7 Drawing Figures

BEARING STOP PLATE ASSEMBLY FOR SLOT MACHINE HANDLE MECHANISM

FIELD OF INVENTION

This invention relates to bearing stop plate assemblies and in particular, a bearing stop plate assembly for use with respect to slot machines.

BACKGROUND OF THE INVENTION

Handle-operated slot machines currently exist in the electro-mechanical mode and in the electronic mode. These types of slot machines are activated by the insertion of coins into the machine and the displacement of the handle mechanism which in turn activates the reel mechanism setting the various reels in rotation and thus commencing the game of chance. The handle mechanism of the slot machine is located on the side of the machine and on the interior of the machine immediately proximate to the handle there exists the handle mechanism assembly. This assembly comprises a series of compression springs and cam actuated rotors which transmit the action of the shift handle to the reels within the machine such that when the handle is displaced downwardly, the handle mechanism on the interior of the machine is activated causing compression in the spring mechanism. The release of the handle causes the compression in the handle and spring mechanism to be released and the energy transferred through a cam to the reel mechanism on the machine. This energy transferred to the reels causes them to rotate thus commencing the game of chance as viewed through the windows on the front of the machine which permit visual access to the pictures on the various reels. The internal handle mechanism is secured to the side of the machine and the reel mechanism is a self-contained unit which sits on a shelf which is suspended between the side of the slot machine opposite the handle mechanism and the interior bearing plate of the handle mechanism. The reel assembly is in alignment with the cam extending outwardly from the handle mechanism and engaging the half gear assembly which in effect activates the rotation of the reels.

The reel assembly itself can weigh from twenty-five to fifty-five pounds. This bearing weight is supported by the aforementioned shelf which spans the distance from the wall opposite the handle mechanism to the interior bearing plate of the handle mechanism. This shelf is secured by threaded fasteners to the wall of the slot machine and to the bearing plate. In addition to the bearing load of the reel mechanism which must be supported by this shelf, the activation of the handle, the compression of the springs in the handle mechanism and the release of same develops a certain amount of torque which is transmitted through the cam shaft, to the half gears and thus to the reels. A portion of this torque is transmitted to the horizontal shelf supporting the reel assembly immediately proximate to the interior bearing plate of the handle mechanism and in combination with the bearing load of the reel mechanism causes the stripping away of the threaded fasteners which secure the shelf to the handle mechanism.

Since the alignment between the handle mechanism, the cam, the half gears and the reel mechanism is critical to the operation of the machine, the stripping away of the threaded fasteners causes the reel mechanism to shift slightly in its alignment with the cam. A shift in alignment of as little as one sixty-fourth of an inch can cause problems. In electromechanical machines, it can reduce the number of handle pulls per hour. It may also result in slower reel spin and a harder handle pull. Additionally, excessive wear on the handle mechanism assembly internal parts and the reels themselves may occur as a result of this misalignment. In electronic games, this misalignment can cause the game to immediately shut down. It is therefore necessary to increase the stability of the shelf plate which secures and supports the reel mechanism such that a higher efficiency of operation can be obtained in the slot machine with less down time, a limit on the wear on the internal parts of the handle mechanism and the reel assembly, and to further convenience the patrons and to permit the slot machine to operate in a higher state of efficiency.

OBJECTS OF THE INVENTION

Accordingly, it is among the objects and advantages of the present invention to provide a handle mechanism bearing plate which can provide additional support to the shelf plate which supports the reels.

It is a further object of the present invention to provide a handle mechanism bearing plate which provides increased stability to the reel assembly and thus increases the efficiency of the slot machine and reduces down time and wear and tear on the internal parts of the machine.

It is a still further object of the present invention to provide a handle mechanism bearing plate which will provide stability to the shelf plate and the reel mechanism without requiring any additional hardware or fastening means to be located within the handle mechanism assembly itself.

SUMMARY OF THE INVENTION

These and other objects of the present invention are achieved by a handle mechanism bearing plate for slot machines wherein said handle mechanism bearing plate has secured thereto, a slide guide bracket designed to receive the downward depending lip of the shelf plate and to limit the downward movement of said shelf plate and to cooperate with the threaded fastening means as a means for further securing the shelf plate to the handle mechanism bracket to secure the alignment of the reel mechanism with the half gears, cam shaft and handle mechanism.

BRIEF DESCRIPTION OF DRAWINGS

These and other objects of the present invention will best be understood with reference to the drawings wherein.

DETAILED DESCRIPTION OF DRAWINGS

Figures 1, 2, 3, 4:
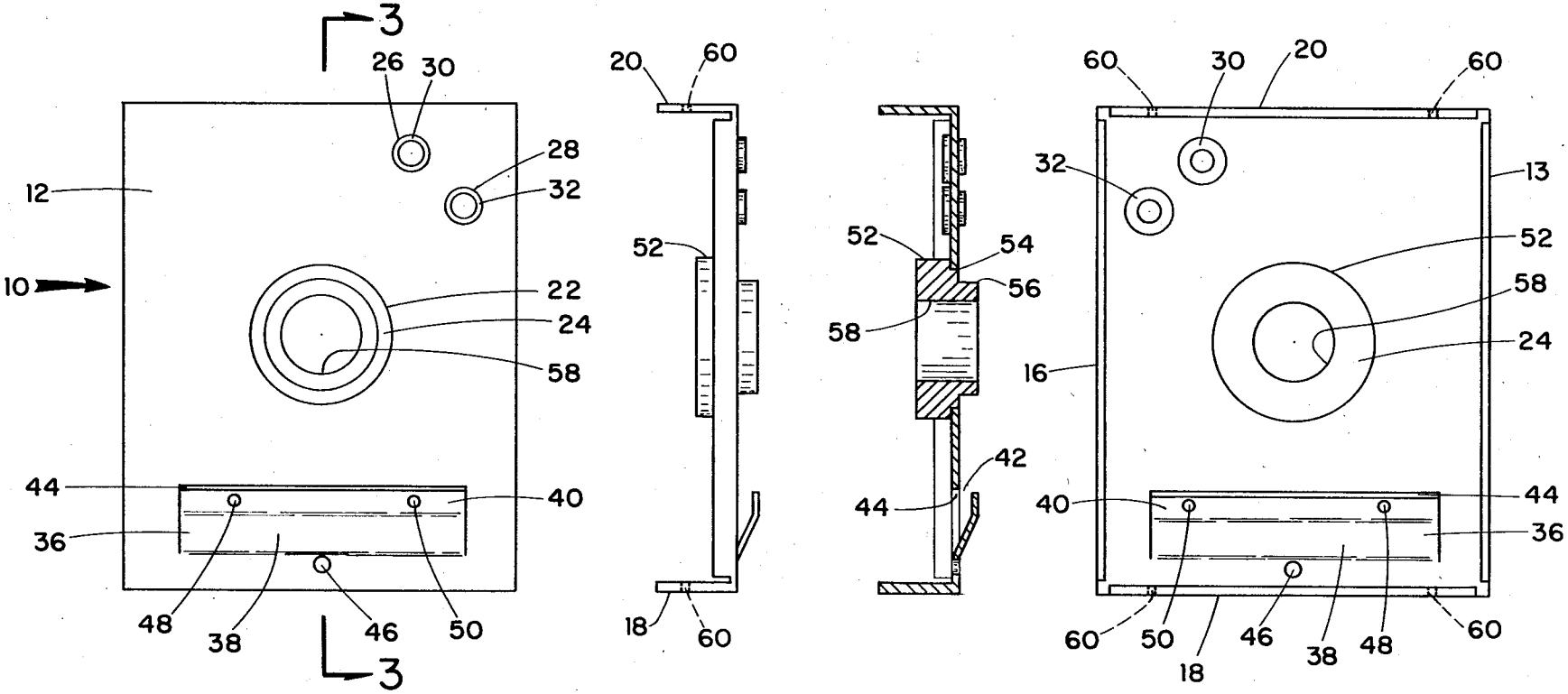
FIG. 1 is a front planer view of the bearing stop plate assembly.
FIG. 2 is a side view of the bearing stop plate assembly.
FIG. 3 is a side cutaway view of the bearing stop plate assembly along plane 3—3.
FIG. 4 is a rear planer view of the bearing stop plate assembly.

Referring to FIGS. 1 through 4 there is shown a front planter view, side and rear view, of the bearing stop plate for a slot machine handle mechanism designated generally as 10. Bearing stop plate 10 is of a one-piece construction having a generally planer front face 12, a generally planer rear face 13, a first verticle side flange 14, a second vertical side flange 16, and a first bottom horizontal flange 18 and a second top horizontal flange 20. Flanges 14, 16, 18 and 20 are angled rearwardly from planer front face 12 at ninety degree angles. Front planer face 12 has a centrally located orifice 22 for receipt of an annular bearing surface 24 as will be more fully explained hereafter. Front planer face 12 also has two orifices 26 and 28 proximate to top horizontal flange 20 and second vertical side flange 16. Orifices 26 and 28 are for the receipt of bearing surfaces 30 and 32 which have application to the internal operating mechanism of the handle mechanism as more fully explained hereafter. Located below central orifice and running parallel to lower horizontal flange 18, is a slide guide 36. Slide guide 36 is cut or stamped from bearing plate 10 such that slide guide 36 protrudes outwardly from planer front surface 12. Slide guide 36 comprises a planer surface 38 obliquely angled with planer front surface 12 and vertical planer surface 40 which is substantially parallel to planer front face 12 such that there is a slight space 42 between vertical planer surface 40 of slide guide 36 and planer front face 12.

In manufacturing bearing stop plate 10, and in stamping out slide guide 36, there is defined a generally rectangular opening 44 in bearing stop plate 10 located directly behind slide guide 36. Located directly beneath slide guide 36 in front face 12 is an opening 46 for aligning bearing stop plate 10 in the slot machine. Additionally, there is positioned on slide guide 36, two circular openings 48 and 50 for fastening means in securing the reel shelf as more fully explained hereafter.

Bearing surfaces 24, 30 and 32 associated with orifices 22, 26 and 28 are frictionally engaged in orifices 22, 26 and 28 respectively. Annular bearing surface 24 is for the receipt of the rack lock shaft which shaft is mechanically secured to the handle mechanism assembly and to the exterior handle of the slot machine. Bearing surfaces 30 and 32 are for the receipt of shafts which undergo repeated partial rotation in the operation of a handle mechanism assembly itself. The design of the bearing surfaces is a choice decision of the manufacturer of the slot machine. It is necessary that the bearing stop plate can be able to accommodate the bearing surfaces. In the instant embodiment, bearing surface 24 has a stepped down circular cross sectional area such that the bearing surface is frictionally engaged with the bearing stop plate 10 by inserting it into orifice 22 from planer rear face 13. In this configuration, the greater cross sectional circular area 52 is in contact with planer rear face 13, circular cross sectional area 54 is frictionally engaged with bearing plate 10 in orifice 22 and is flush with front surface 12 of same, and an annular lip 56 extends outwardly from front planer face 12. Bearing surface 24 defines an opening therethrough 58 which is substantially identical in cross sectional area with the cross sectional area of the rack lock shaft which would pass therethrough. Bearing surfaces 30 and 32 are of similar construction.

Referring to FIG. 2, a side view of bearing stop 10, there can be seen that the flanges 14, 16, 18 and 20 are angled rearwardly from front face 12 and that horizontal flanges 18 and 20 each contain a plurality of identical openings 60 for the receipt of a fastening means in order to secure bearing stop plate 10 to the handle mechanism assembly as more fully explained hereafter. It can also be seen from FIG. 3 that slide guide 36 when stamped from bearing stop plate 10 defines a generally rectangular opening 44 in bearing stop plate 10 and that planer surface 40 of slide guide 36 is substantially parallel to planer front face 12 thereby defining space 42 between vertical planer surface 40 of slide guide 36 and planer front face 12.

Figure 5:
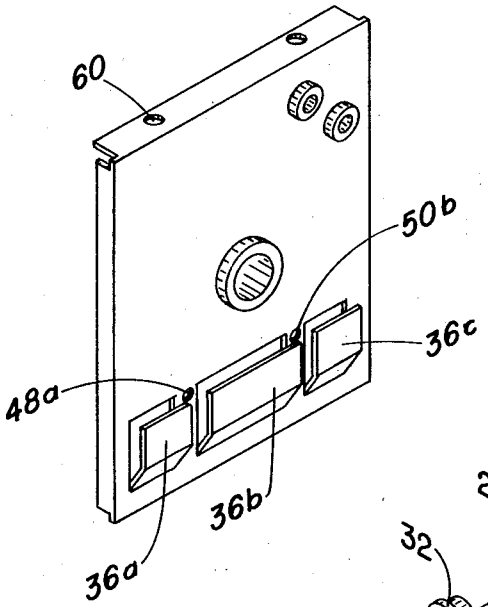
FIG. 5 is a front prospective view of the bearing stop plate assembly showing a second embodiment.

Referring to FIG. 4, the rear planer view of bearing stop plate 10, there is another perspective showing the relationship of slide guide 36 to bearing stop plate 10 and also further exhibiting the relationship of bearing surfaces 24, 30 and 32 to bearing stop plate 10 and in particular, generally planer rear face 13. Referring to FIG. 5, there is a front prospective view of a second embodiment of a bearing stop plate 10. Bearing stop plate 10 as shown in FIG. 5 is identical to bearing stop plate 10 as shown in FIG. 1 with the exception that the embodiment of slide guide 36 has been modified. In FIG. 1, slide guide 36 is comprised of a single stamped piece, substantially parallel to first bottom flange 18 and extending substantially across the width of bearing stop plate 10. In the second embodiment as shown in FIG. 5, slide guide 36 comprises a plurality of stamped portions. As shown in FIG. 5, slide guide 36 comprises three portions, **36*a*, 36*b* and 36*c*. Slide guide portions 36*a*, 36*b* and 36*c* accomplish the same results as slide guide 36 and are accommodations to the means of manufacture with the exception that in the embodiment shown in FIG. 5, circular openings 48*a* and 50*b*, which are the equivalent of circular openings 48 and 50 in FIG. 1, for fastening means, remain in bearing stop plate 10 and not slide guide 36 as shown in FIG. 1. In this configuration as more fully described hereafter, the real shelf would be fastened directly to the bearing stop plate 10 with slide guides 36*a*, 36*b* and 36*c* providing the same additional support as slide guide 36 in FIG. 1**.

Figure 6:
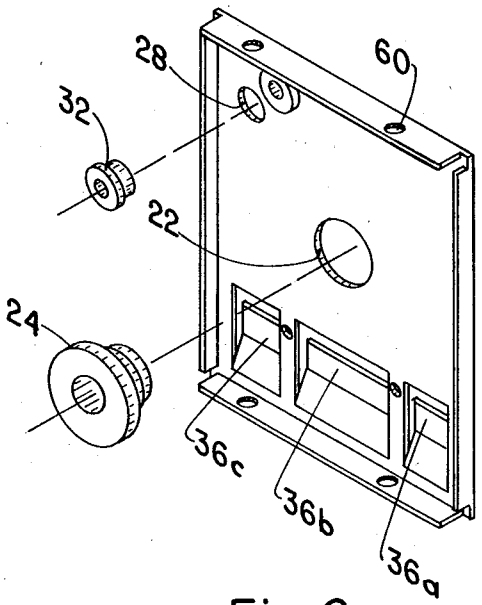
FIG. 6 is a rear prospective of the bearing stop plate assembly showing the second embodiment.

Referring to FIG. 6, there is a rear prospective view of the second embodiment showing an explored view with respect to bearing surfaces 24 and 28.

Figure 7:
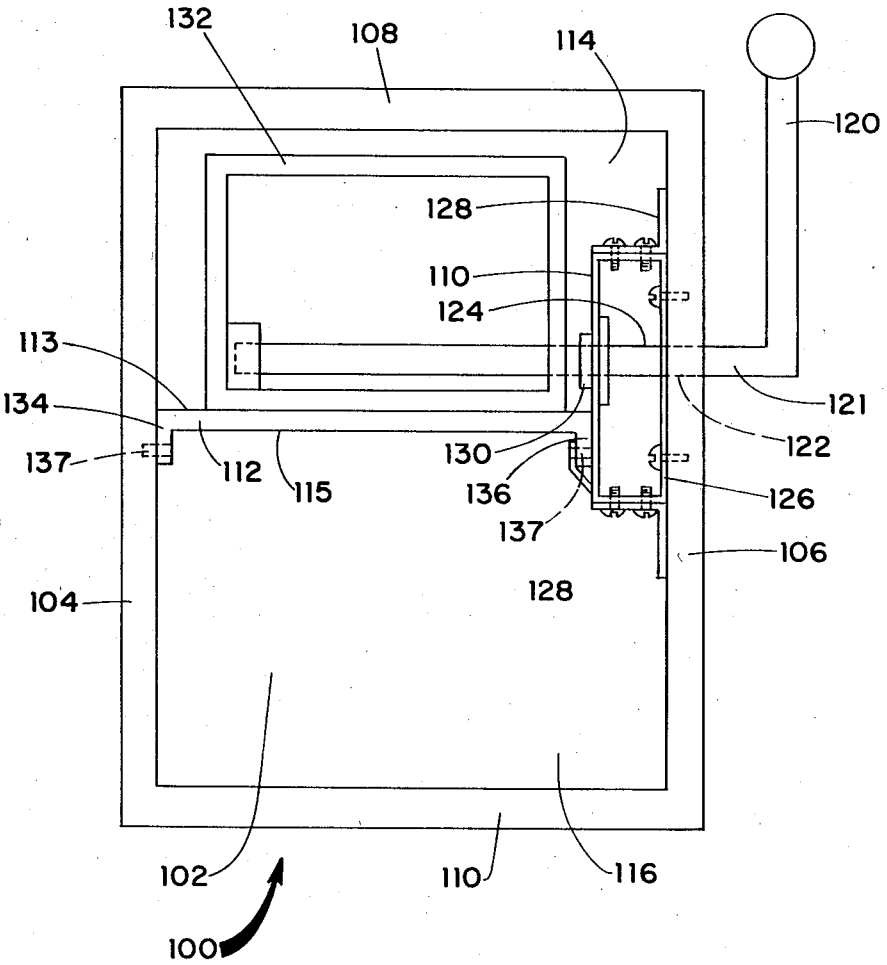
FIG. 7 is a simplified interior front view of a slot machine showing the bearing stop plate assembly in cooperation with the handle mechanism and the reel shelf.

Referring to FIG. 7, there is shown a simplified interior view of a slot machine designated generally as 100. FIG. 7 is a front view with the front face of the machine removed. It can be seen that slot machine 100 comprises a hollow rectangular chamber 102 defined by sidewalls 104 and 106, top wall 108 and bottom wall 110. Reel shelf 112 divides interior chamber 102 into an upper and lower portion 114 and 116 respectively. The electronic and electromechanical connections for the slot machine would be displaced in upper and lower sections 114 and 116 respectively. However, these electronic and electromechanical portions do not have direct application to the instant invention. Situated on reel shelf 112 would be the reel mechanism assembly 132 comprising a series of gears and reels for rotation in order to play the game of chance, the reels comprising the pictures which the player attempts to match in order to win the game.

Situated on the exterior of sidewall 106 is handle 120. Handle 120 is used by the player to activate the mechanism. Horizontal rack lock shaft 121 extends from handle 120 through sidewall 106 through throughbore 122 and into the handle mechanism assembly 124. The handle mechanism assembly 124 is disposed between bearing stop plate 10 which is the subject matter of this invention and stop plate 126 which is similar to bearing stop plate 10 but has no slide guide 36. Bearing stop plate 10 and stop plate 126 are secured to each other and positioned by L-shaped brackets 128 such that bearing surfaces 24, 30 and 32 in bearing stop plate 10 are in alignment with similar bearing surfaces in stop plate 126. The handle mechanism assembly disposed between bearing stop plate 10 and stop plate 126 comprises a series of levers and compression springs which are activated by rotation of rack lock shaft 121 by the downward movement of handle 120. The termination of the downward movement of handle 120 releases the energy stored in the compression of the handle mechanism assembly. Cam surface 130 is in intimate contact with the reel mechanism designated generally as 132 and the energy transmitted through cam surface 130 causes the reel mechanism to commence rotation for the game of chance. The reel mechanism 132 is supported on reel shelf 112. Reel shelf 112 comprises a flat planer upper surface 113, a lower surface 115 and depending flanges 134 and 136 at its ends. Flanges 134 and 136 have a plurality of openings 137 therethrough for threaded fasteners in order to secure reel shelf 112 to sidewall 104 of the slot machine and to the manner in which the reel shelf 112 is secured to bearing stop plate 10 in order to provide additional support for reel shelf 112 and reel mechanism 132 in order to prevent reel shelf 112 from shifting from its position such that cam surface 130 is out of alignment with reel mechanism 132.

It can be seen from FIG. 7, that reel shelf 112 extends horizontally across interior chamber 102 of slot machine 100. Reel shelf 112 is secured to sidewall 104 by threaded fasteners and is secured to bearing stop plate 10 by threaded fasteners. Bearing stop plate which is the subject matter of the present invention provides additional support to reel shelf 112. As can be seen from FIG. 7, downward depending flanges 132 and 134 of reel shelf 12 have a plurality of openings for threaded fasteners. Downward depending flange 134 is further supported by slide guide 36 in that downward depending flange 134 slips between front planer face 12 of bearing stop plate 10 and inner parallel surface 40 of slide guide 36 such that the top of slide guide 36 contacts lower surface 115 of reel shelf 112 to provide the additional support necessary to support reel shelf 112 and reel mechanism 132.

The design of bearing stop plate 10 provides additional support for reel mechanism 132 and in doing so, provides greater strength in order to absorb the energy forces created through the action of the slot machine handle and the levers and compression springs located in the handle mechanism assembly. Thus providing greater stability and strength for reel shelf 112, bearing stop plate 10 ensures alignment of the handle mechanism assembly and the reel mechanism for a greater length of time thereby permitting the machine to remain in use for a longer period of time without maintenance.

It will be recognized by those skilled in the art, that while the invention has been described in connection with the exemplary embodiment thereof, it will be understood that many modifications will be apparent to those of ordinary skill in the art and that this application is intended to cover any adaptations or variations thereof. Therefore, it is manifestly intended that this invention be only limited by the claims and the equivalents thereof.

I claim:

1. A bearing stop plate assembly for slot machines for support of the reel shelf and alignment of the reel mechanism and handle mechanism comprising a bearing plate having a first side and a second side; perimeter flanges perpendicular to said second side, said perpendicular flanges having a plurality of openings for securing said bearing plate in said slot machine; a horizontal slide guide extending outwardly from said first side of said bearing plate for cooperation with a downwardly depending lip of said reel shelf; a plurality of openings in said horizontal slide guide to receive threaded fastening means for securing said reel shelf; a plurality of openings through said bearing plate for the positioning and alignment of said handle and reel mechanism.

2. A bearing stop plate assembly for slot machines in accordance with claim 1 wherein said horizontal slide guide on said first side of said bearing plate is a continuous one piece assembly extending outwardly from said first side of said bearing plate having said plurality openings in said slide guide for receipt of said fastening means.

3. A bearing stop plate assembly for slot machines for support of the reel shelf and alignment of the reel mechanism and handle mechanism comprising a bearing plate having a first side and a second side; perimeter flanges perpendicular to said second side, said perpendicular flanges having a plurality of openings for securing said bearing plate in said slot machine; a segmented horizontal slide guide extending outwardly from said first side of said bearing plate for cooperation with a downwardly depending lip of said reel shelf; a plurality of openings in said first side of said bearing plate to receive threaded fastening means for securing said reel shelf; and a plurality of openings throughout said bearing plate for the positioning and alignment of said handle and reel mechanism.

* * * * *